US011773837B1

(12) United States Patent
Arrieta et al.

(10) Patent No.: US 11,773,837 B1
(45) Date of Patent: Oct. 3, 2023

(54) COMPRESSOR

(71) Applicant: T/CCI Manufacturing, L.L.C., Decatur, IL (US)

(72) Inventors: Edward M. Arrieta, Decatur, IL (US); Richard B. Ennis, Taylorville, IL (US); Fanglin Zeng, Ganzhou (CN); Deguo Weng, Ningbo (CN)

(73) Assignee: T/CCI Manufacturing, L.L.C., Decatur, IL (US)

( * ) Notice: Subject to any disclaimer, the term of this patent is extended or adjusted under 35 U.S.C. 154(b) by 0 days.

(21) Appl. No.: 17/832,238

(22) Filed: Jun. 3, 2022

(51) Int. Cl.

| | |
|---|---|
| ***F04B 27/08*** | (2006.01) |
| ***F04B 1/295*** | (2020.01) |
| ***F04B 1/124*** | (2020.01) |
| ***F04B 1/14*** | (2020.01) |
| ***F04B 27/10*** | (2006.01) |

(52) U.S. Cl.
CPC ..... *F04B 27/0878* (2013.01); *F04B 1/124* (2013.01); *F04B 1/295* (2013.01); *F04B 1/14* (2013.01); *F04B 27/10* (2013.01); *F04B 27/1054* (2013.01); *F04B 27/1063* (2013.01)

(58) Field of Classification Search
CPC ..... F04B 27/10; F04B 27/12; F04B 27/1054; F04B 27/1063; F04B 1/14; F04B 1/16; F04B 27/0878; F04B 27/0882; F04B 27/0886; F04B 27/18; F04B 1/124; F04B 1/126; F03C 1/0406; F03C 1/0419; F03C 1/02; F01B 1/0644
See application file for complete search history.

(56) References Cited

U.S. PATENT DOCUMENTS

RE15,756 E * 2/1924 Michell ..... F16H 23/10 74/56
2,027,076 A * 1/1936 Volliman ..... F04B 27/12 417/269
2,320,526 A * 6/1943 Landis ..... F01B 3/04 123/56.8
3,057,545 A * 10/1962 Ransom ..... F04B 27/1045 417/269
3,319,878 A * 5/1967 Steinhagen ..... F25B 31/00 417/269
3,380,651 A * 4/1968 Niki ..... F04B 27/1081 417/269
3,885,460 A * 5/1975 Park ..... F04B 27/0878 277/587
3,930,758 A * 1/1976 Park ..... F04B 27/12 184/6.16
4,289,453 A * 9/1981 Shibuya ..... F04B 27/109 417/269
4,364,306 A * 12/1982 Hattori ..... F04B 27/0878 417/269
4,415,315 A * 11/1983 Shibuya ..... F04B 27/109 417/269
4,470,761 A * 9/1984 Mukai ..... F04B 27/0878 92/159
4,505,122 A * 3/1985 Inomata ..... F04B 49/246 62/133

(Continued)

*Primary Examiner* — Kenneth J Hansen
*Assistant Examiner* — Benjamin Doyle
(74) *Attorney, Agent, or Firm* — Philip L. Bateman

(57) ABSTRACT

A swash plate compressor has bosses on the inner faces of the bridges of its pistons that contact the outer face of the swash plate only between the edges to eliminate wear at the edges and to thereby increase the life of the compressor.

15 Claims, 7 Drawing Sheets

(56) References Cited

U.S. PATENT DOCUMENTS 4,522,112 A * 6/1985 Nomura ..... F04B 27/109 92/158
4,583,922 A * 4/1986 Iijima ..... F04B 39/121 417/313
4,704,073 A * 11/1987 Nomura ..... F04B 27/109 184/6.17
4,789,311 A * 12/1988 Ikeda ..... F04B 27/1054 417/269
4,886,024 A * 12/1989 Meredith ..... F01B 3/04 123/223
5,100,306 A * 3/1992 Moran, Jr. ..... F04B 39/1073 417/571
5,139,392 A * 8/1992 Pettitt ..... F04B 27/12 417/269
5,452,647 A * 9/1995 Murakami ..... F04B 1/126 74/56
5,921,756 A * 7/1999 Matsuda ..... F04B 27/12 91/499
6,217,295 B1 * 4/2001 Kato ..... F04B 27/0878 92/155
6,367,368 B1 * 4/2002 Ganster ..... F04B 27/0878 92/165 PR
6,412,171 B1 * 7/2002 Kato ..... F04B 27/0878 29/888.04
6,438,834 B1 * 8/2002 Takamatsu ..... F04B 27/0878 29/888.047
6,739,236 B2 * 5/2004 Kato ..... F04B 27/0878 92/248
6,834,636 B2 * 12/2004 Thomas ..... F04B 39/1073 123/43 AA
6,925,925 B2 * 8/2005 Casar ..... F04B 27/0878 92/172
7,056,100 B2 * 6/2006 Schwarzkopf ..... F04B 27/0878 91/499
7,464,673 B2 * 12/2008 Thomas ..... F02B 41/04 123/43 AA
7,997,880 B2 * 8/2011 Lim ..... F04B 27/1018 417/269
8,419,382 B2 * 4/2013 Sato ..... F04B 27/109 91/499
8,668,388 B1 * 3/2014 Peterson ..... F16C 33/26 384/42
9,169,835 B2 * 10/2015 Takahashi ..... F04B 27/1009
10,145,370 B2 * 12/2018 Ogawa ..... F04B 27/005
2001/0027721 A1 * 10/2001 Kato ..... F04B 27/0878 92/260
2002/0174764 A1 * 11/2002 Kato ..... F04B 27/1054 92/70
2003/0044292 A1 * 3/2003 Shiina ..... F04B 27/0878 417/269
2004/0118149 A1 * 6/2004 Tsunoda ..... F04B 27/1036 62/505
2005/0188835 A1 * 9/2005 Le ..... F04B 27/0878 92/71
2006/0255675 A1 * 11/2006 Saito ..... F16C 17/107 310/90
2017/0284381 A1 * 10/2017 Ogawa ..... F04B 27/1045
2017/0356490 A1 * 12/2017 Santiago ..... F16C 17/042

* cited by examiner

COMPRESSOR

FIELD OF THE INVENTION

This invention relates to compressors. More particularly, this invention relates to swash plate compressors.

BACKGROUND OF THE INVENTION

Refrigeration systems containing a fluid that changes from liquid to vapor (a phase change commonly known as vaporization) and back to liquid again (a phase change commonly known as condensation) are common in motor vehicles, buildings, appliances, and industrial operations. Refrigeration systems are commonly known as air conditioners when the enclosure being cooled is occupied by people.

Refrigeration systems feature two heat exchangers, a compressor, an expansion valve, and a refrigerant fluid. Arbitrarily choosing the compressor as the starting point, the fluid enters the compressor as a low pressure and low temperature vapor. The vapor is compressed and leaves the compressor as a high pressure and high temperature vapor. The vapor then passes through the first heat exchanger (known as the condenser and located in the ambient surroundings). The vapor releases heat to the surroundings and condenses into a liquid. The liquid then passes through the expansion valve where the pressure and temperature decrease. The cold, low pressure liquid then passes through the second heat exchanger (known as the evaporator and located in the enclosure to be cooled). The liquid accepts heat from the enclosure and evaporates into a low pressure and low temperature vapor. The vapor then returns to the compressor to complete and restart the cycle.

A variety of compressors are used in refrigeration systems. One type of compressor is known as a swash plate compressor. A conventional swash plate compressor 10 is shown in FIGS. 1 to 4. The compressor includes a block 11 having an inlet 12, an outlet 13, and a plurality of cylinders 14. As shown, the inlet and outlet are typically part of a separate head portion that bolts to the portion of the block containing the cylinders. A rotating drive shaft 15 contains a swash plate 16. The swash plate is inclined (is at an oblique angle) relative to the drive shaft. The swash plate engages five pistons 17 located in the cylinders. Each piston contains a solid bridge portion and a complementary empty recess portion extending between the two full cylindrical ends of the piston. The swash plate extends into the recess and causes reciprocating motion to the pistons as the swash plate and drive shaft rotate. A spherical joint comprising a ball 18 held between indentations in a shoe 19 and a piston is positioned between each side of the piston and each side of the swash plate. The drive shaft, the swash plate, one piston, and spherical joints are shown in their operating configuration in FIG. 3 with other components omitted for clarity. These components are shown in exploded view in FIG. 4.

Swash plate compressors are used in many different types of refrigeration systems and are especially preferred for use in motor vehicle refrigeration systems for several reasons. The compressors are compact and generally have a displacement of about 50 to 800 cubic centimeters. Unless otherwise indicated, the term "about" is used herein to mean plus or minus 25 percent of the measurement or other property referenced. The compressor also has relatively few moving parts. It also delivers a relatively constant flow of compressed fluid because volumes of compressed fluid from each cylinder are delivered to the compressor outlet with each rotation of the drive shaft.

As the swash plate rotates, the pistons reciprocate and also tend to rotate slightly. The rotation of the pistons is limited by contact between the bridge of the pistons and the outer face of the swash plate. Contact also occurs between the spherical joints and the front and rear faces of the swash plate. Over time, these areas of contact cause wear on the components and can eventually cause failure of the compressor.

Accordingly, there is a demand for an improved swash plate compressor that has an increased life.

SUMMARY OF THE INVENTION

The general object of this invention is to provide an improved swash plate compressor. A more particular object is to provide a swash plate compressor that has an increased life.

We have invented an improved swash plate compressor. The compressor comprises four major components: (a) a block; (b) a rotating drive shaft; (c) a rotating swash plate; and (d) a plurality of reciprocating pistons. The first three components are conventional.

The block has: (i) a block inlet for accepting a fluid at a first pressure; (ii) a block outlet for discharging the fluid at a higher pressure; (iii) a central recess for accepting a drive shaft and defining an axis; and (iv) a plurality of hollow cylinders arranged around the central recess, each cylinder having an axis parallel to the axis of the central recess, each cylinder having an inlet communicating with the block inlet and an outlet communicating with the block outlet.

The rotating drive shaft in the central recess of the block has an axis that is coaxial with the axis of the central recess.

The rotating swash plate is attached to the drive shaft. The swash plate is inclined relative to the drive shaft and has: (i) a front face defining a front plane, (ii) a rear face defining a rear plane, the rear plane being parallel to the front plane of the front face; (iii) an outer face extending between the front face and the rear face and forming a front edge where the outer face meets the front face and forming a rear edge where the outer face meets the rear face, the outer face being parallel to the drive shaft axis.

The pistons reciprocate within the cylinders as the swash plate rotates. Each piston has cylindrical ends and a central recess into which the swash plate extends. Each piston has a bridge complementary to the recess connecting the ends. Each bridge has a front face overlapping the front face of the swash plate, a rear face overlapping the rear face of the swash plate, and an inner face with a boss that contacts the outer face of the swash plate only between the front edge and rear edge throughout an entire rotation of the swash plate such that no contact occurs between the piston and the front edge or rear edge of the swash plate.

The compressor of this invention has an increased life. It is believed the primary reason for the increased life is that the boss on the inner face of the piston bridge eliminates contact between the piston and the front edge or rear edge of the swash plate.

DETAILED DESCRIPTION OF THE INVENTION

1. The Compressor in General

Figure 1:
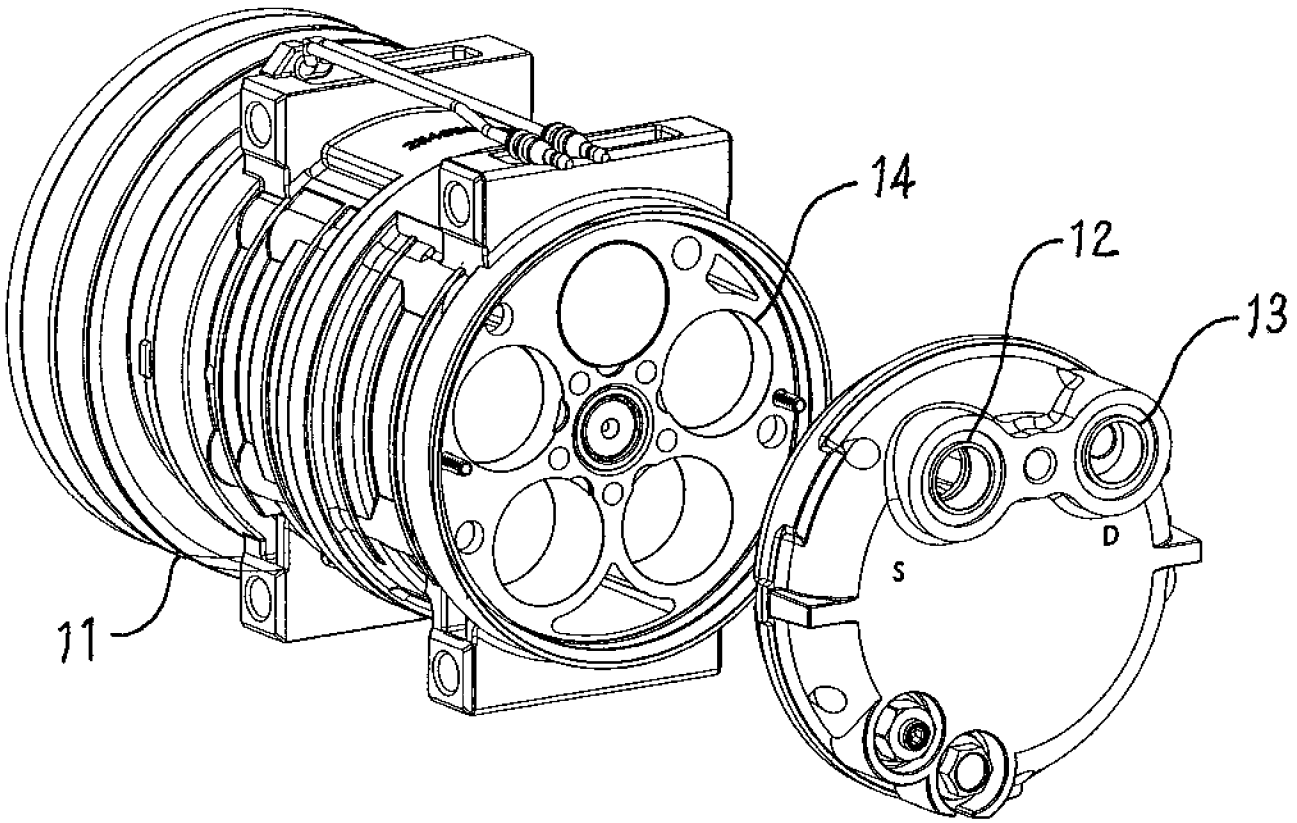
FIG. 1 (PRIOR ART)
FIG. 1 is a perspective partially exploded view of a prior art swash plate compressor.
Figure 2:
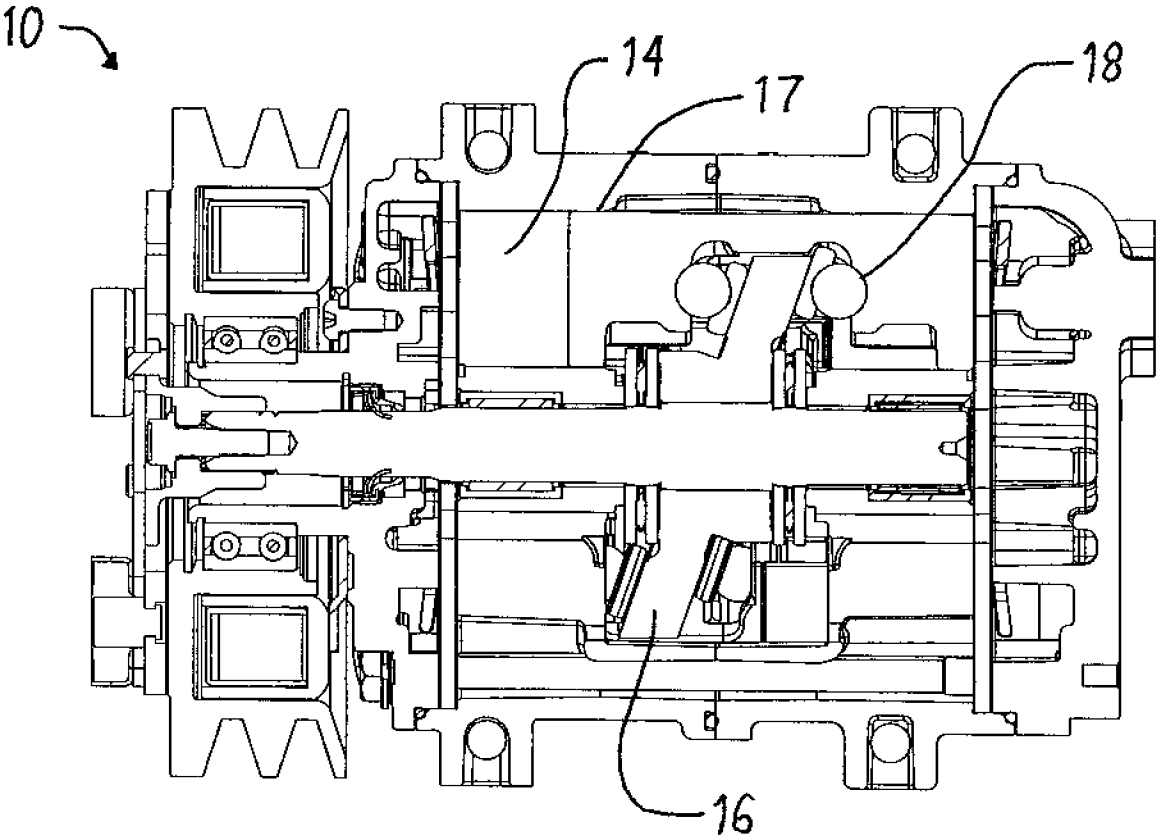
FIG. 2 (PRIOR ART)
FIG. 2 is a sectional view thereof.
Figure 3:
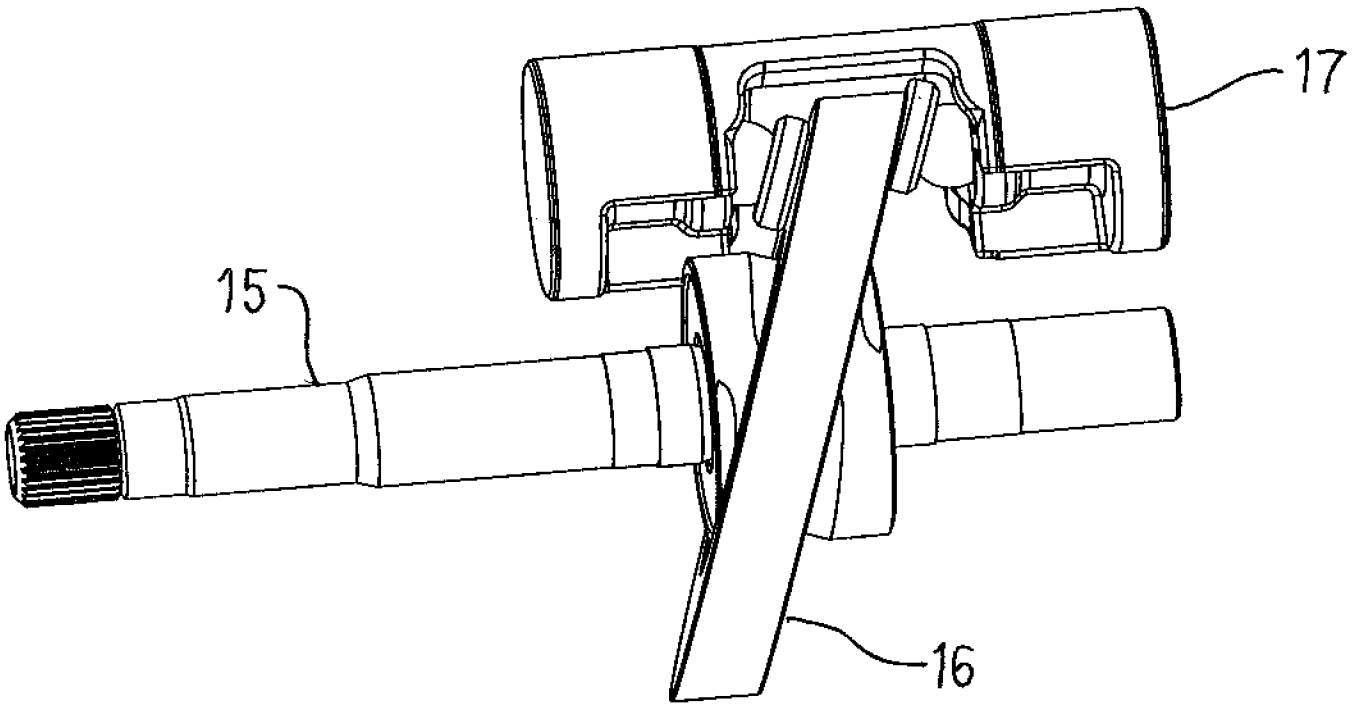
FIG. 3 (PRIOR ART)
FIG. 3 is a perspective assembled view of components thereof.
Figure 4:
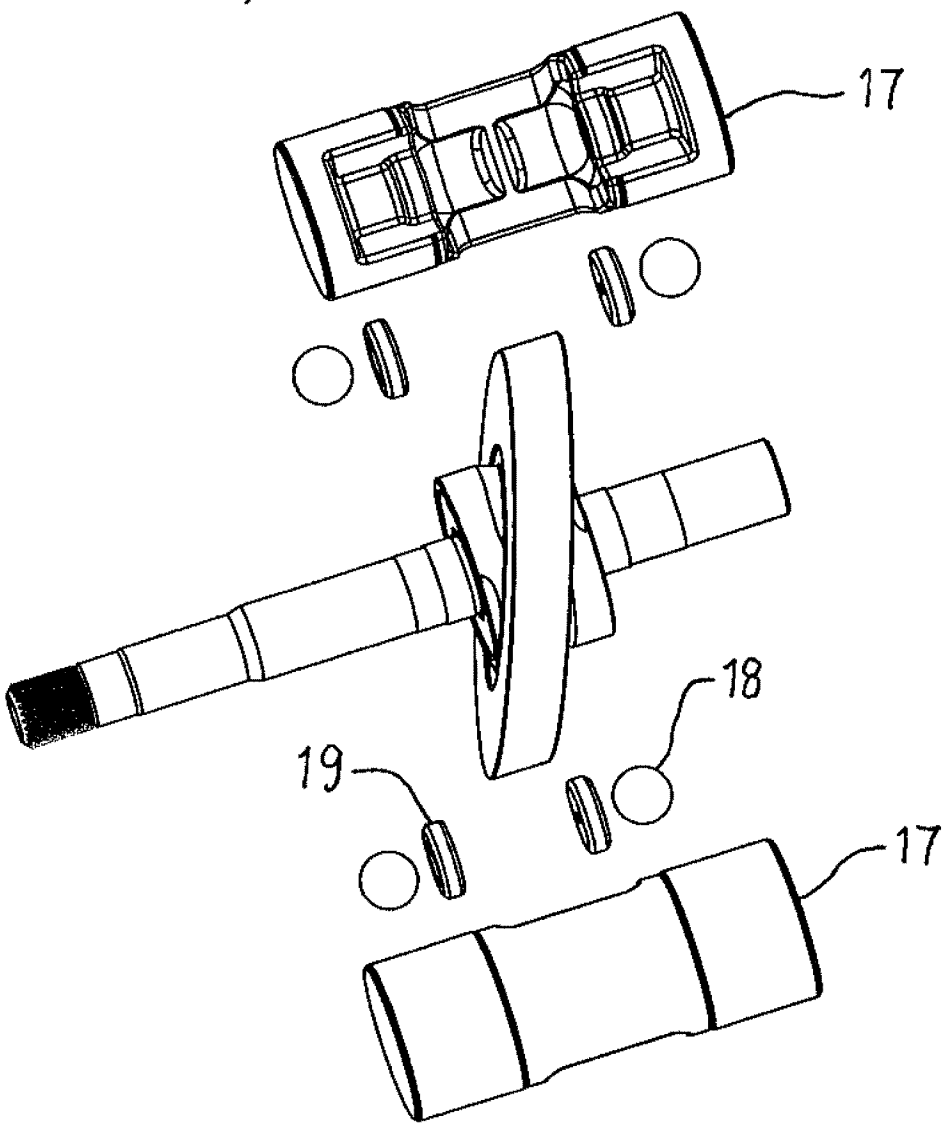
FIG. 4 (PRIOR ART)
FIG. 4 is a perspective exploded view thereof.
Figure 5:
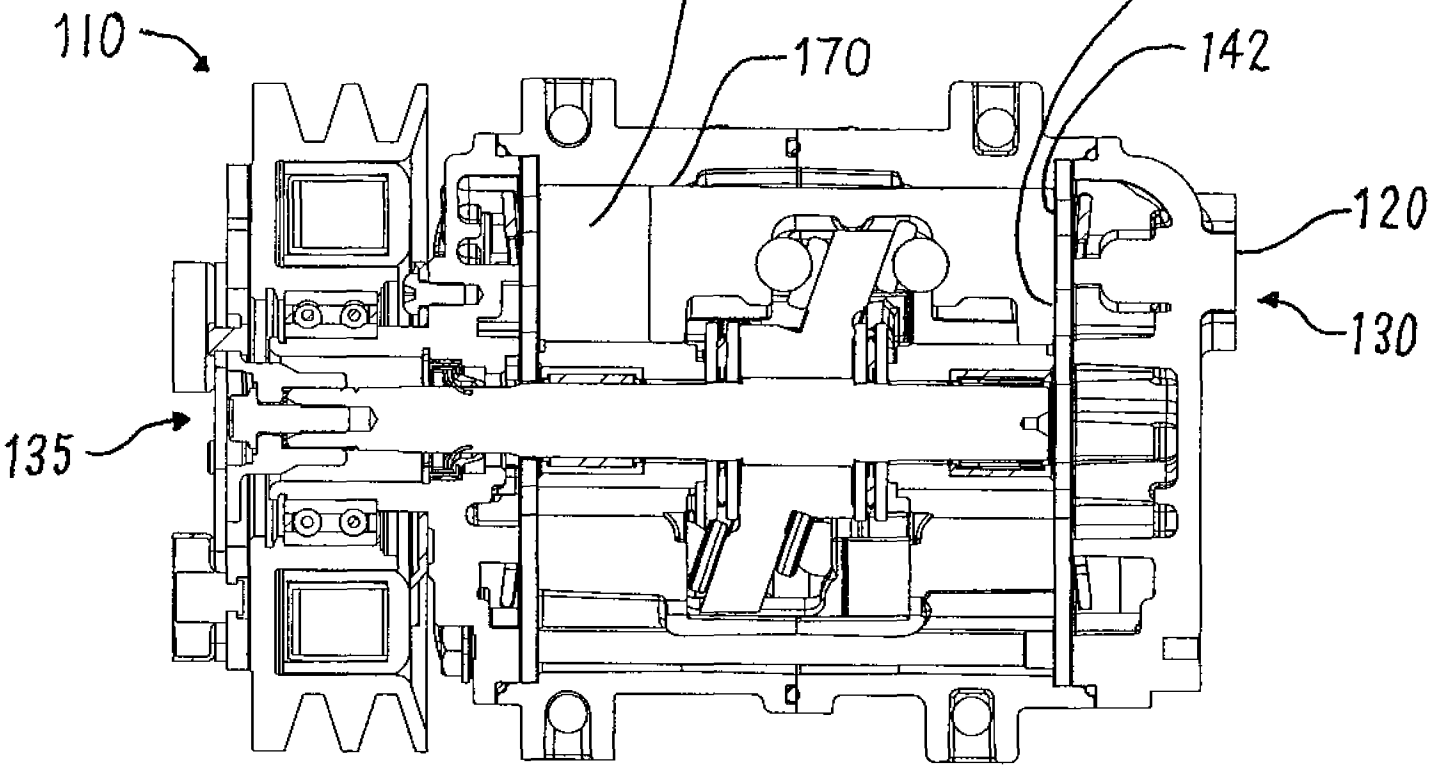
FIG. 5 is a sectional view of a preferred embodiment of the swash plate compressor of this invention.
Figure 6:
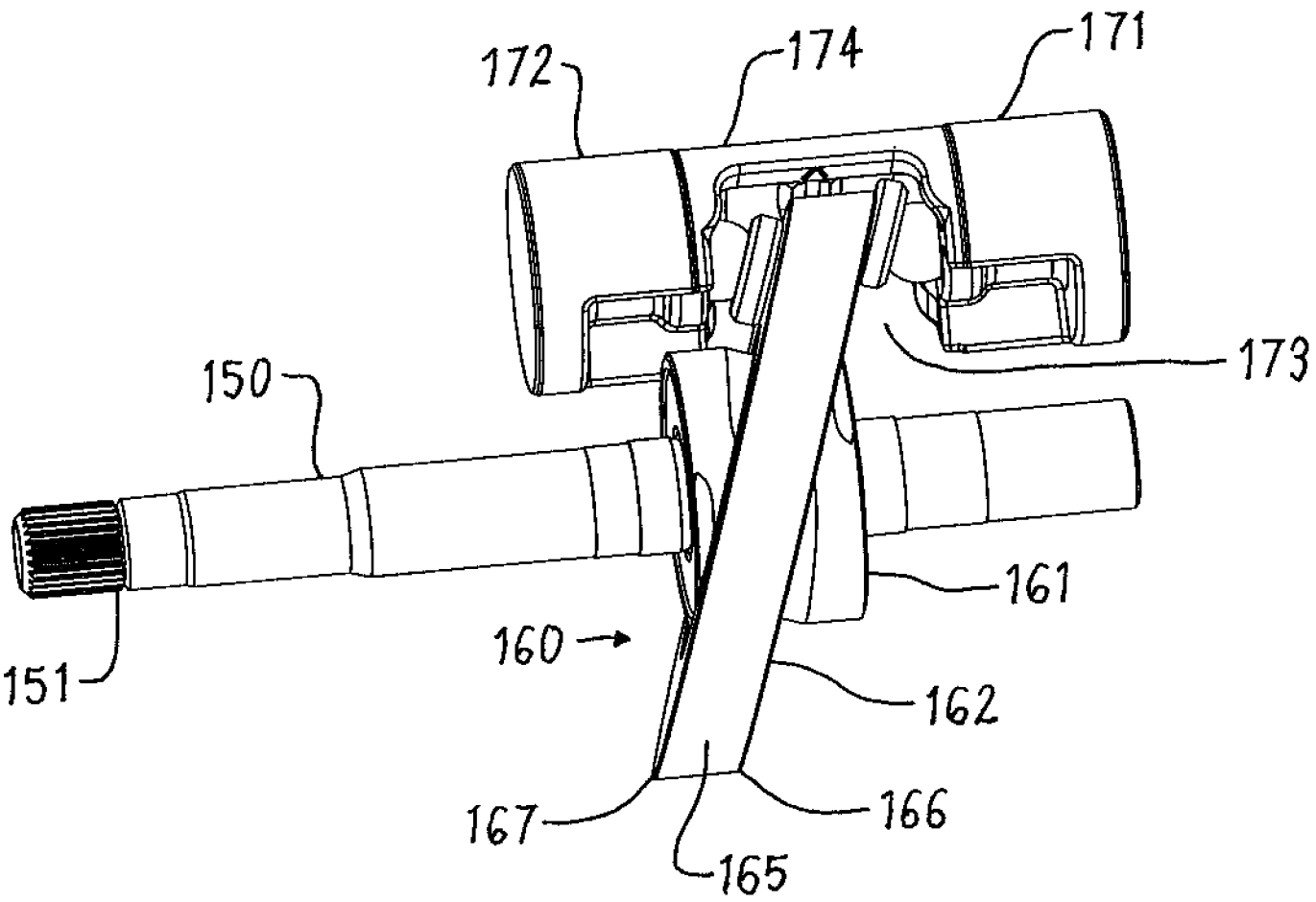
FIG. 6 is a perspective assembled view of components thereof.

This invention is best understood by reference to the drawings. Referring to FIGS. 5 to 8, a preferred embodiment of the compressor 100 of this invention comprises a block 110 having a fluid inlet 120, a fluid outlet 130, a plurality of cylinders 140, a rotating drive shaft 150 with an attached swash plate 160, and a plurality of pistons 170. Balls 180 and shoes 190 form spherical joints between the swash plate and the pistons. All the components of the compressor except for the pistons are conventional. Each piston has an inner face with a boss that contacts the outer face of the swash plate only between the front edge and the rear edge throughout an entire rotation of the swash plate. Thus, there is no contact between the piston and front edge or rear edge of the swash plate.

The compressor of this invention is suited for use in any refrigeration systems, but is especially suited for use in an air conditioning system in a motor vehicle. The compressor of this invention functions the same regardless of the direction of rotation of the drive shaft. The fluid inlet and fluid outlet stay the same regardless of rotation direction. The terms "front" and "rear" as used herein are chosen arbitrarily with the rear of the compressor being the end containing the fluid inlet and fluid outlet.

While not wishing to be bound by theory, it is believed that contact between the pistons and the front edge and rear edge of the swash plate in conventional swash plate compressors causes wear and unevenness at the outer edges of the swash plate. As can be seen in in the upper piston of FIG. 5, the spherical joints extend outwardly over the edge of the swash plate during a portion of the swash plate rotation. Therefore, any wear or unevenness on the outer edges of the swash plate caused by the pistons causes wear and unevenness on the mating surface of the spherical joints. And, any wear or unevenness of the surface of the spherical joints causes wear and unevenness on the front and rear faces of the swash plate. Eliminating contact between the pistons and the front and rear edges of the swash plate thus reduces wear on the spherical joints and on the front and rear faces of the swash plate.

The absence of contact between the pistons and the front edge or rear edge of the swash plate in the compressor of this invention is believed to be primarily responsible for its increased life.

2. The Block

The block 110 of the compressor is conventional. The block has an inlet 120 for accepting a fluid at a first pressure and an outlet 130 for discharging the fluid at a higher pressure. The inlet and outlet are generally part of a separate head portion. The fluid is generally a refrigerant. The block also has a central recess 135 for accepting a drive shaft. The central recess defines an axis. The block also has a plurality of hollow cylinders 140 arranged around the central recess. The preferred embodiment shown contains five cylinders. The compressor generally contains three to seven cylinders. Increasing the number of cylinders provides a more constant supply of pressurized fluid, but also increases the number of parts. The cylinders are typically equally spaced radially. The axis of each cylinder is parallel to the axis of the central recess. Each cylinder has an inlet 141 that communicates with the block inlet. Each cylinder also has an outlet 142 that communicates with the block outlet. The portion of the block containing the cylinders is generally made of two or more parts connected together.

3. The Rotating Drive Shaft

The rotating drive shaft 150 of the compressor is conventional. The drive shaft rotates within the central recess of the block. One end 151 of the drive shaft is connected to a drive means. In motor vehicles, the drive means is typically the engine or motor of the motor vehicle connected to the drive shaft with gears, belts, or the like.

4. The Swash Plate

The swash plate 160 of the compressor is conventional. The swash plate is circular and is attached to the drive shaft at an oblique angle so that it is inclined relative to the drive shaft. The swash plate generally includes a mounting ring 161 portion and a plate portion 162. The swash plate has a rear face 163 that defines a rear plane and a front face 164 that defines a front plane. The rear plane and the front plane are parallel to each other. The angle formed by the faces to the drive shaft varies around the circumference of the drive shaft. The angle formed by the front face to the drive shaft and the angle formed by the rear face to the drive shaft are supplementary in that their measurements add to 180 degrees at any point around the circumference of the drive shaft. The angle typically varies from an acute angle of about 10 to 30 degrees to an obtuse angle of about 150 to 170 degrees. The swash plate also has an outer face 165 that extends between the front face and the rear face. The outer face is parallel to the drive shaft axis. The outer face has a rear edge 166 where the outer face meets the rear face and a front edge 167 where the outer face meets the front face.

5. The Pistons

The pistons 170 of the compressor are conventional except for the bosses. Each piston is generally cylindrical and fits tightly within a cylinder. Each piston has cylindrical ends 171 and 172 with small cut outs to accommodate (avoid contact with) the swash plate mounting ring. Each piston has a recess 173 into which the swash plate extends and a bridge 174 that connects the two cylindrical ends of the piston. The recess and the bridge together form an imaginary complete cylinder that extends between, and connects, the two cylindrical ends of the piston. The empty recess and the solid bridge are thus complementary. The bridge has a rear face 175 that overlaps the rear face of the swash plate. The bridge also has a front face 176 that overlaps the front face of the swash plate. As explained below, the front faces of the bridge and swash plate and the rear faces of the bridge and swash plate generally do not contact each other directly. Instead, a spherical joint is generally interposed between the faces to facilitate movement, reduce friction, and to distribute wear. When a spherical joint is interposed, the front face and the rear face of the piston bridge generally contains an indentation (also referred to as a socket) to retain the spherical joint.

Figures 7, 8:
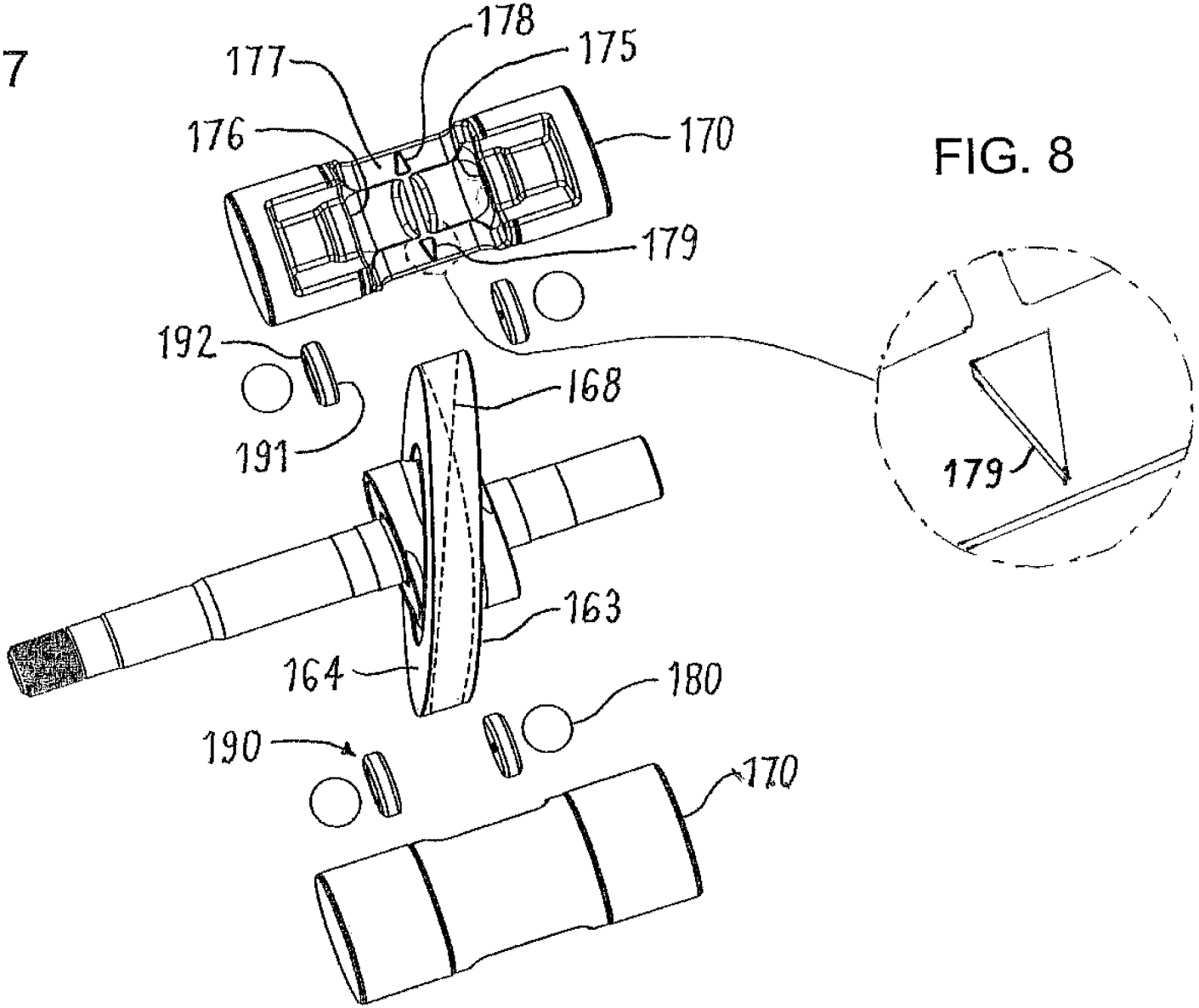
FIG. 7 is a perspective exploded view thereof.
FIG. 8 is a detailed view of one of the bosses thereof.

The bridge also has inner face 177 that contacts the outer face of the swash plate. The inner face of the bridge of the preferred embodiment has two bosses 178 and 179 that rise above the surface. These bosses are the only points of contact between the inner face of the bridge and the outer face of the swash plate. Furthermore, these bosses contact the outer face of the swash plate only between the front edge and the rear edge of the swash plate. Over time, the contact between the bosses and the outer face of the swash plate create wear patterns on the outer face. The wear patterns 168 are shown in FIG. 7.

The size, shape, and location of the bosses are matters of choice, provided they make the only contact between the inner face of the piston bridge and the outer face of the swash plate and provided the bosses contact the outer face only between the front edge and the rear edge, i.e., without contacting either the front edge or the rear edge. The bosses are preferably located equidistant between the front and rear faces of the bridge. As best seen in FIG. 7, each piston of the preferred embodiment contains two spaced apart bosses. As best seen in FIG. 8, the bosses of the preferred embodiment are triangular in cross-sectional shape because this shape maximizes the cross-sectional area that can contact the outer face of the swash plate without contacting either edge. Other shapes are also suitable. The bosses are generally cast or forged as part of the piston.

6. The Spherical Joints

The spherical joints are conventional and preferably consist of balls 180 and shoes 190. Each shoe has a flat side 191 that contacts the front or rear face of the swash plate. Each shoe also has an indented side 192 that retains a ball that contacts the front or rear face of the piston bridge. The indentation is also referred to as a socket. There are two spherical joints per piston. One joint is interposed between the front faces of each piston bridge and the swash plate and one joint is interposed between the rear faces of each piston bridge and the swash plate. The spherical joints facilitate movement between the piston and the swash plate with a minimum of friction. An alternative spherical joint (not shown) is a semi-hemispherical ball with a flat side. The rounded portion of the ball fits into an indentation in the piston and the flat side of the ball contacts the front or rear face of the swash plate.

7. Operation

The operation of the compressor can now be considered in detail. The operation is generally conventional. The drive shaft and the swash plate rotate. As the swash plate rotates, it causes the pistons to reciprocate. Each reciprocation receives a volume of the refrigerant fluid, compresses it to a smaller volume, and then discharges it. During operation, the inner faces of the pistons contact the outer face of the swash plate. The compressor of this invention differs from prior compressors in that contact between inner faces of the pistons and outer face of the swash plate occurs only between the front and rear edges. In other words, the pistons do not contact the front and rear edges and, thus, cause no wear on the edges. Eliminating piston-caused wear on the outer edges of the swash plate has been found to create a cascading effect of additional benefits. Eliminating piston-caused wear reduces unevenness and wear on the outer edges. This, in turn, reduces unevenness and wear on the flat faces of the spherical joints and this, in turn, reduces unevenness and wear on the front and rear faces of the swash plate.

8. Advantages

Compared to prior swash plate compressors, the swash plate compressor of this invention has the advantage of eliminating contact between the pistons and outer edges of the outer face of the swash plate. This eliminates piston-caused wear on the outer edges. It has been discovered that eliminating piston-caused wear on the outer edges also reduces uneven wear on the spherical joints which, in turn, reduces uneven wear on the front and rear faces of the swash plate. Reducing wear on these components increases the life of the compressor.

While the compressor of this invention is generally manufactured and sold as a complete unit, the pistons with the bosses can be substituted for conventional pistons in an existing conventional compressor.

We claim:

1. A compressor comprising:

(a) a block having: (i) a block inlet for accepting a fluid at a first pressure; (ii) a block outlet for discharging the fluid at a higher pressure; (iii) a central recess defining an axis; and (iv) a plurality of hollow cylinders arranged around the central recess, each cylinder having an axis parallel to the axis of the central recess, each cylinder having an inlet communicating with the block inlet and an outlet communicating with the block outlet;

(b) a rotating drive shaft in the central recess having an axis that is coaxial with the axis of the central recess;

(c) a rotating swash plate attached to the rotating drive shaft, the swash plate being inclined relative to the rotating drive shaft and having: (i) a front face defining a front plane, (ii) a rear face defining a rear plane, the rear plane being parallel to the front plane of the front face; (iii) an outer face extending between the front face and the rear face and forming a front edge where the outer face meets the front face and forming a rear edge where the outer face meets the rear face, the outer face being parallel to the rotating drive shaft axis; and (d) a plurality of reciprocating pistons, one in each hollow cylinder, each piston reciprocating within a cylinder as the swash plate rotates, each piston having cylindrical ends and a central recess into which the swash plate extends, each piston having a bridge complementary to the recess connecting the cylindrical ends, each bridge having a front face overlapping the front face of the swash plate, a rear face overlapping the rear face of the swash plate, and an inner face with a at least one boss that contacts the outer face of the swash plate only between the front edge and rear edge throughout an entire rotation of the swash plate such that no contact occurs between the piston and the front edge or rear edge of the swash plate.

2. The compressor of claim 1 additionally comprising a spherical joint between the front face of each piston bridge and the front face of the swash plate and a spherical joint between the rear face of each piston bridge and the rear face of the swash plate.

3. The compressor of claim 2 wherein each piston inner face has two bosses.

4. The compressor of claim 3 wherein the bosses on each piston bridge inner face are located equidistant between the front face and the rear face of the bridge.

5. The compressor of claim 4 wherein the bosses on each piston bridge inner face are triangular in cross section.

6. A compressor comprising:

(a) a block having: (i) a block inlet for accepting a fluid at a first pressure; (ii) a block outlet for discharging the fluid at a second pressure, which second pressure is greater than the first pressure; (iii) a central recess defining an axis; and (iv) a plurality of hollow cylinders arranged around the central recess, each cylinder having an axis parallel to the axis of the central recess, each cylinder having an inlet communicating with the block inlet and an outlet communicating with the block outlet;

(b) a drive shaft adapted for rotation in the central recess having an axis that is coaxial with the axis of the central recess;

(c) a swash plate adapted for rotation attached to the drive shaft, the swash plate being inclined relative to the drive shaft and having: (i) a front face defining a front plane, (ii) a rear face defining a rear plane, the rear plane being parallel to the front plane of the front face; (iii) an outer face extending between the front face and the rear face and forming a front edge where the outer face meets the front face and forming a rear edge where the outer face meets the rear face, the outer face being parallel to the drive shaft axis; and (d) a plurality of pistons adapted for reciprocation, one in each hollow cylinder, each piston adapted for reciprocation within a each respective cylinder as the swash plate rotates, each piston having cylindrical ends and a central recess into which the swash plate extends, each piston having a bridge complementary to the recess connecting the cylindrical ends, each bridge having a front face overlapping the front face of the swash plate, a rear face overlapping the rear face of the swash plate, and an inner face with a at least one boss that contacts the outer face of the swash plate only between the front edge and rear edge throughout an entire rotation of the swash plate such that no contact occurs between the piston and the front edge or rear edge of the swash plate.

7. The compressor of claim 6 additionally comprising a spherical joint between the front face of each piston bridge and the front face of the swash plate and a spherical joint between the rear face of each piston bridge and the rear face of the swash plate.

8. The compressor of claim 7 wherein each piston bridge inner face has two bosses.

9. The compressor of claim 8 wherein the bosses on each piston bridge inner face are located equidistant between the front face and the rear face of the bridge.

10. The compressor of claim 9 wherein the bosses on each piston bridge inner face are triangular in cross section.

11. A piston for a swash plate compressor, the swash plate having a front face, a rear face, and an outer face extending between the front face and the rear face and forming a front edge where the outer face meets the front face and forming a rear edge where the outer face meets the rear face, the piston having cylindrical ends and a central recess into which the swash plate extends, each piston having a bridge complementary to the recess and connecting the cylindrical ends, each bridge having a front face overlapping the front face of the swash plate, a rear face overlapping the rear face of the swash plate, and an inner face with a at least one boss that contacts the outer face of the swash plate only between the front edge and rear edge throughout an entire rotation of the swash plate such that no contact occurs between the piston and the front edge or rear edge of the swash plate.

12. The piston of claim 11 wherein the front face and the rear face of the piston contain sockets for receiving a spherical joint.

13. The piston of claim 12 wherein the piston bridge inner face has two bosses.

14. The piston of claim 13 wherein the two bosses are located equidistant between the front face and the rear face of the bridge.

15. The piston of claim 14 wherein the bosses are triangular in cross section.

* * * * *